US007147555B1

(12) United States Patent
Harpaz

(10) Patent No.: US 7,147,555 B1
(45) **Date of Patent: *Dec. 12, 2006**

(54) GAMES GRID BOARD

(76) Inventor: Yehouda Harpaz, 129 Corrie Road, Cambridge, Cambs (GB) CB1 3QQ ( * ) Notice: Subject to any disclaimer, the term of this patent is extended or adjusted under 35 U.S.C. 154(b) by 668 days.

This patent is subject to a terminal disclaimer.

(21) Appl. No.: 10/031,776

(22) PCT Filed: Jul. 11, 2000

(86) PCT No.: PCT/GB00/02656

§ 371 (c)(1),
(2), (4) Date: Jan. 23, 2002

(87) PCT Pub. No.: WO01/14026

PCT Pub. Date: Mar. 1, 2001

(30) Foreign Application Priority Data

Aug. 19, 1999 (GB) ..... 9919551.3
Feb. 8, 2000 (GB) ..... 0002736.7

(51) Int. Cl.
*A63F 3/02* (2006.01)
*G06F 19/00* (2006.01)

(52) U.S. Cl. ..... 463/9; 273/237; 273/429

(58) Field of Classification Search ..... 463/9; 273/236–237, 287, 271, 284, 260, 263, 267, 273/283

See application file for complete search history.

(56) References Cited

U.S. PATENT DOCUMENTS 4,114,890 A * 9/1978 Yamamoto et al. ..... 273/237
4,244,635 A * 1/1981 Sasaki et al. ..... 349/1
4,279,421 A * 7/1981 Tepoorten et al. ..... 273/237
4,513,973 A * 4/1985 Sinclair ..... 273/237
5,417,425 A * 5/1995 Blumberg et al. ..... 273/153 R
5,603,500 A * 2/1997 Olti et al. ..... 273/153 R
5,743,796 A * 4/1998 Orak et al. ..... 463/9
6,042,117 A * 3/2000 O'Brien ..... 273/281
6,231,441 B1 * 5/2001 Golad ..... 463/9
6,568,683 B1 * 5/2003 Harpaz ..... 273/460

FOREIGN PATENT DOCUMENTS

GB 2097265 A * 11/1982

(Continued)

OTHER PUBLICATIONS

OS2World, Lites Out!, Jan. 1997, taken from Internet, www.os2world, com/games/html/lites_out_.thml.*

(Continued)

*Primary Examiner*—John M. Hotaling, II
*Assistant Examiner*—Alex F. R. P. Rada, II

(57) ABSTRACT

A board is made of many grid points 1 & 2 arranged in a grid on a flat surface 6, and connected to a game manager 3 (a CPU+memory+software). Each grid point notifies the games manager when it is pressed, and the games manager can illuminate each grid point by one of two color. The boards plays a game in which a point is a legal move if its 'visibility' for the player is above or equal some value. The 'visibility' of a point is determined by checking in turn each of a predefined set of imaginary straight lines emanating from the point. If the line does not pass through any illuminated point, it is assigned a value of 0. Otherwise the line is assigned a value of 1 if the closest illuminated point that it passes through is illuminated in the colour of the player, or −1 if it is in the opponent's color. The sum of the values of the lines is the 'visibility' of the point for the player.

1 Claim, 6 Drawing Sheets

FOREIGN PATENT DOCUMENTS

| | | | |
|---|---|---|---|
| GB | 2147817 A | * | 5/1985 |
| GB | 2334680 A | * | 9/1999 |
| GB | 2339393 A | * | 1/2000 |
| GB | 2341107 A | * | 3/2000 |
| GB | 2341108 A | * | 3/2000 |
| GB | 2341109 A | * | 3/2000 |
| GB | 2341110 A | * | 3/2000 |
| GB | 2341111 A | * | 3/2000 |

OTHER PUBLICATIONS

Internet Archive, Othello, Feb. 1999, www.web.archive.org/web/19990210053422/http://members.aol.com/shadows125/othello.*

Brithish Othello Federation, Rules of Othello, circa 1998, www.britishothello.org.*

* cited by examiner

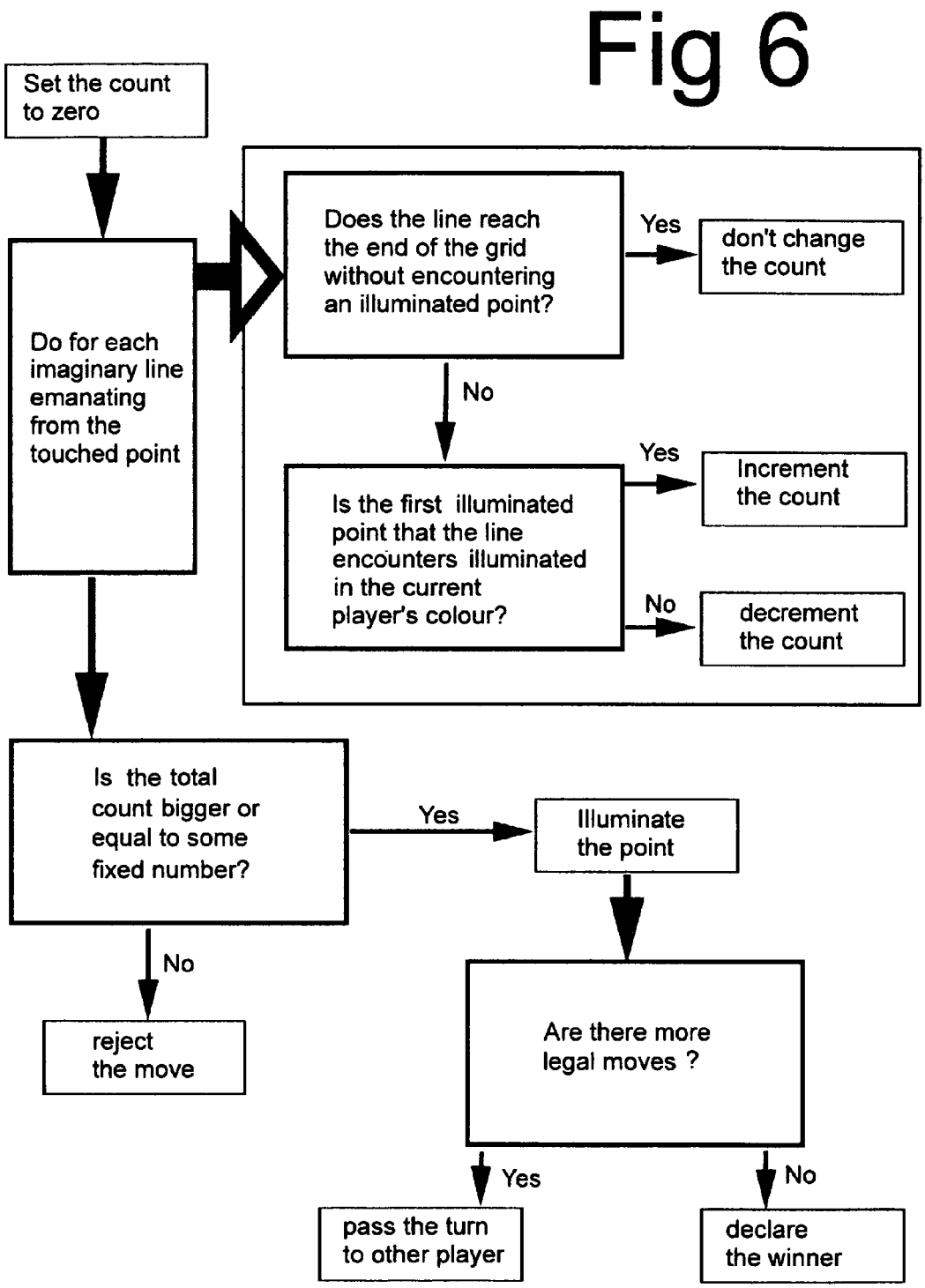
Fig 6
Set the count to zero
Do for each imaginary line emanating from the touched point
Does the line reach the end of the grid without encountering an illuminated point?
Yes
don't change the count
No
Is the first illuminated point that the line encounters illuminated in the current player's colour?
Yes
Increment the count
No
decrement the count
Is the total count bigger or equal to some fixed number?
Yes
Illuminate the point
No
reject the move
Are there more legal moves ?
Yes
pass the turn to other player
No
declare the winner

GAMES GRID BOARD

CROSS-REFERNCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERNCE OF MATERIAL SUBMITTED ON A COMPACT DISC

Not applicable

BACKGROUND OF THE INVENTION

This invention relates to board games in which a move is done by indicating a point on the board, and the state of the game is expressed in the state of the points. These include traditional games like Go, but also large number of other potential games, puzzles and exercises. The invention presents an electronic board to play these games, and a new kind of game to play on it.

Games like Go are played by each player, in his turn, adding a pebble to the board, on one of the points in a grid of lines drawn on the board, or in one of the squares on the board. These games have the advantages of being based on simple playing acts and being interesting intellectually. Their disadvantages are:

1) They require somewhat tricky movement when putting the stone on the board in the right place without disturbing other stones.

2) They tend to suffer from delays when a player is thinking on a move.

3) Some of the moves require additional 'housekeeping' operations, e.& taking stones of the board in Go.

4) The players need to keep the rules and do the counting of stones themselves, which puts extra demand on the players.

5) The stones are separate objects, which are easily lost.

Disadvantages 3–5 can be solved by programming a computer to display the board and stones. The program would be simple enough that it can be put on a small and cheap CPU, and hence be built into a standalone playing board. In principle, the computer could also limit the time allocated to each player, thus solving disadvantage 2.

The problem of input (disadvantage 1), however, is not solved so well by current electronic systems. That is because input for existing electronic systems is normally done through buttons, or other devices, which are separated from the display. For games where there is a small repertoire of possible different inputs this is acceptable, but for board games here are many possible different inputs (the number of points in the grid). Inputting a point on buttons off the display requires the players to perform some mental operation to convert the point they think about to the right input.

This is relatively slow and error-prone process. For slow-going games that is very annoying but may be acceptable, but it makes it impossible to play fast on these systems, and for most people this is a decisive factor.

This disadvantage can be overcome by a making a hoard in which the input and the display are together, and these kind of boards started to appear, at least in the form of patent applications. However, the range of the games that can be played on these board is still limited. The current invention describes such a simple board and a novel games with many interesting variations which can be played on it.

BRIEF SUMMARY OF THE INEVNTION

The conceptual structure of the hardware of the board is sketched in FIG. 1.

According to the current invention the user accessible part of the board is made of grid points 1 & 2 which are arranged in a grid on a flat Surface 6. Each grid point is a clearly visible element 1 which can detect when it is pressed, and can be illuminated in at least two colours by an illumination source 2 in or below the surface. The figure shows only 3 grid points for clarity, but the actual board has many more grid points (typically 36–1000). The figure also shows the illumination source 2 separately from the visible part of the grid point 1, which denotes the fact that pressing a grid point does not affect its illumination. All the grid points are connected to a games manager 3, which is a CPU+memory+software. When a grid point is pressed, the games manager 3 is notified (arrows from the visible part 1 to the games manager 3), and the games manager 3 controls which sources of illumination are on (arrows from the games manager 3 to the sources of illumination 2). The games manager is programmed to manage various games. Managing a game means that the board displays the state of the game by putting on the appropriate sources of illumination 2. When a sensor 1 is pressed, the games manager computes the implication according the rules of the current game, and changes some of the sources of illumination 2 (possibly none) to reflect the new state of the game. The board may also change which sources of illumination are on when no point is pressed. This board can be used to implement many games.

According to the current invention, some of these games are variations of the novel game Visiput. The basic rules of Visiput are:

Each player in their turn switch on an unilluminated point with their colour by pressing it, provided it is a legal move. A point is a legal move if its 'visibility' for the player is above or equal to some fixed number. The 'visibility' of a point is determined by checking in turn each of a predefined set of imaginary straight lines emanating from the point. If the line does not pass through any illuminated point, it is assigned a value of 0. Otherwise the line is assigned a value of 1 if the closest illuminated point that it passes through is illuminated in the colour of the player, or −1 if it is in the opponent's colour. The sum of the values of the lines is the 'visibility' of the point for the player. The game ends when neither of the players has a legal move, and the player with more points of his/her colour wins.

BRIEF DESCRIPTION OF THE SEVERAL VIEWS OF THE DRAWING

FIG. 6 shows the flow chart of the present embodiment.

DETAILED DESCRIPTION OF THE INVENTION

Figure 1:
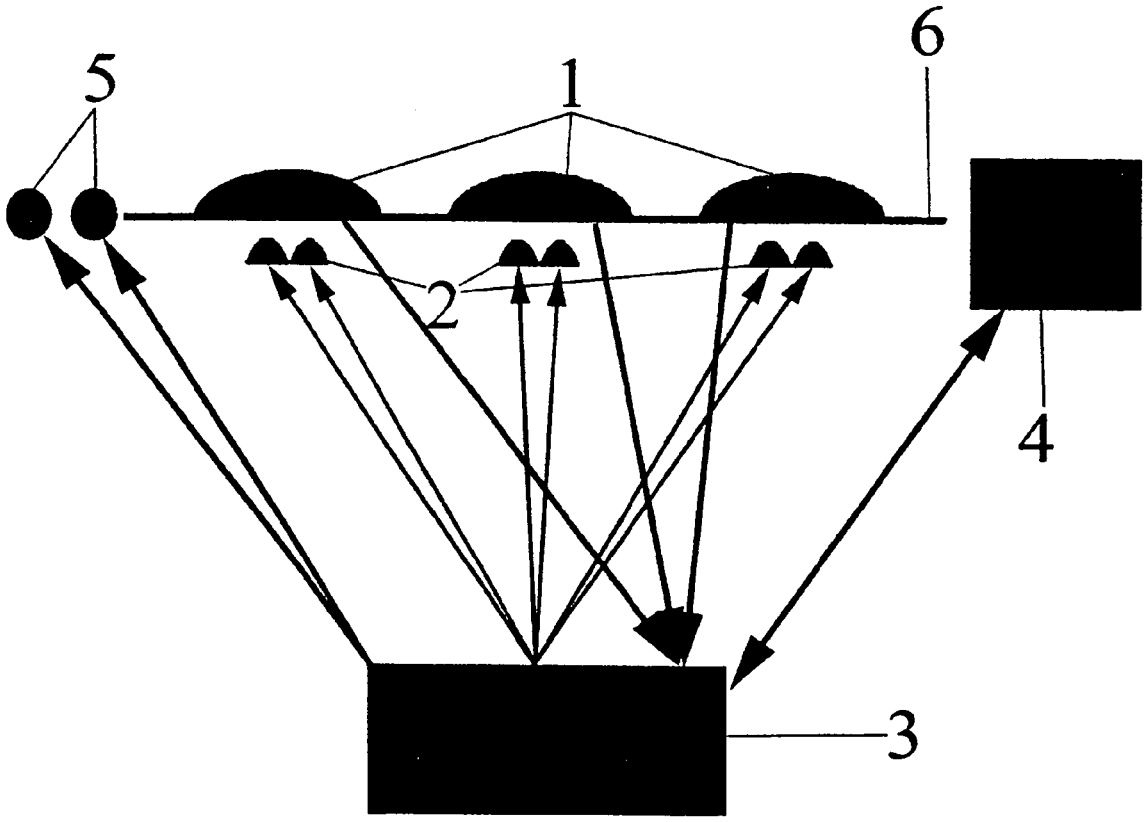
FIG. 1 shows the conceptual structure of the board.

To allow the users to utilise all the functionality of the board, it will need a control area 4, which allows the players to change the current game, change the rules of the current game and change other parameters, like the length of time that each player has to perform his move. The control area 4 also displays the current score of the game. Typically, the control area will contain few control buttons and an alphanumeric display. The games manager receives information from the control area about which control buttons were pressed, and controls what is displayed in the alphanumeric display.

The basic functionality of the games manager comprises these actions:

1) When the users indicate through the control area 4 that they want to change the current game or any of the parameters of the current game, the game manager sets its own internal state to the new value, and indicates to the users the new value.
2) When one of the grid points is pressed and the current game and parameters make it illegal for the current player to press some of the points, the games manager checks if the pressed point is allowed according to the rules and parameters of the current game and the current state of the game (i.e. which points are illuminated). If the pressed point is not allowed, the games board may issue some indication that an illegal point was pressed, may indicate why it is not allowed by some message through the control area 4, and may indicate which points are allowed (e.g. by flashing them). Note that illuminated points, while typically are not allowed, may be allowed in some games.
3) When a point is pressed and it is allowed according to the current rules, parameters and state of the game, the games manager computes the implications and then changes the illumination of some (possibly zero) points to reflect the new state of the game. Note that:
   a) While typically the point that is pressed changes its illumination, this is not mandatory.
   b) Other points except the pressed point may change as well.
4) If the rules of the current game require it, the games manager changes the illumination of some points even when none of the points is pressed, typically once each some time period (or 'generation').
5) After each change to the illumination of any grid point, the games manager computes the current score and displays it using the control area 4.
6) After each change to the illumination of any grid point, the games manager checks using a game-specific routine, if the game is finished. If the game is finished, the games manager indicates it, typically by some message in the control area 4, and maybe other additional signals.

The board will also need a way to signal whose turn it is, which would typically be done by two turn lights 5, which are in two separate colours, corresponding to two of the colours of the illumination in the grid points. The games manager controls these turn lights, and signal to the players whose turn it is by switching the corresponding turn light.

Figure 3:
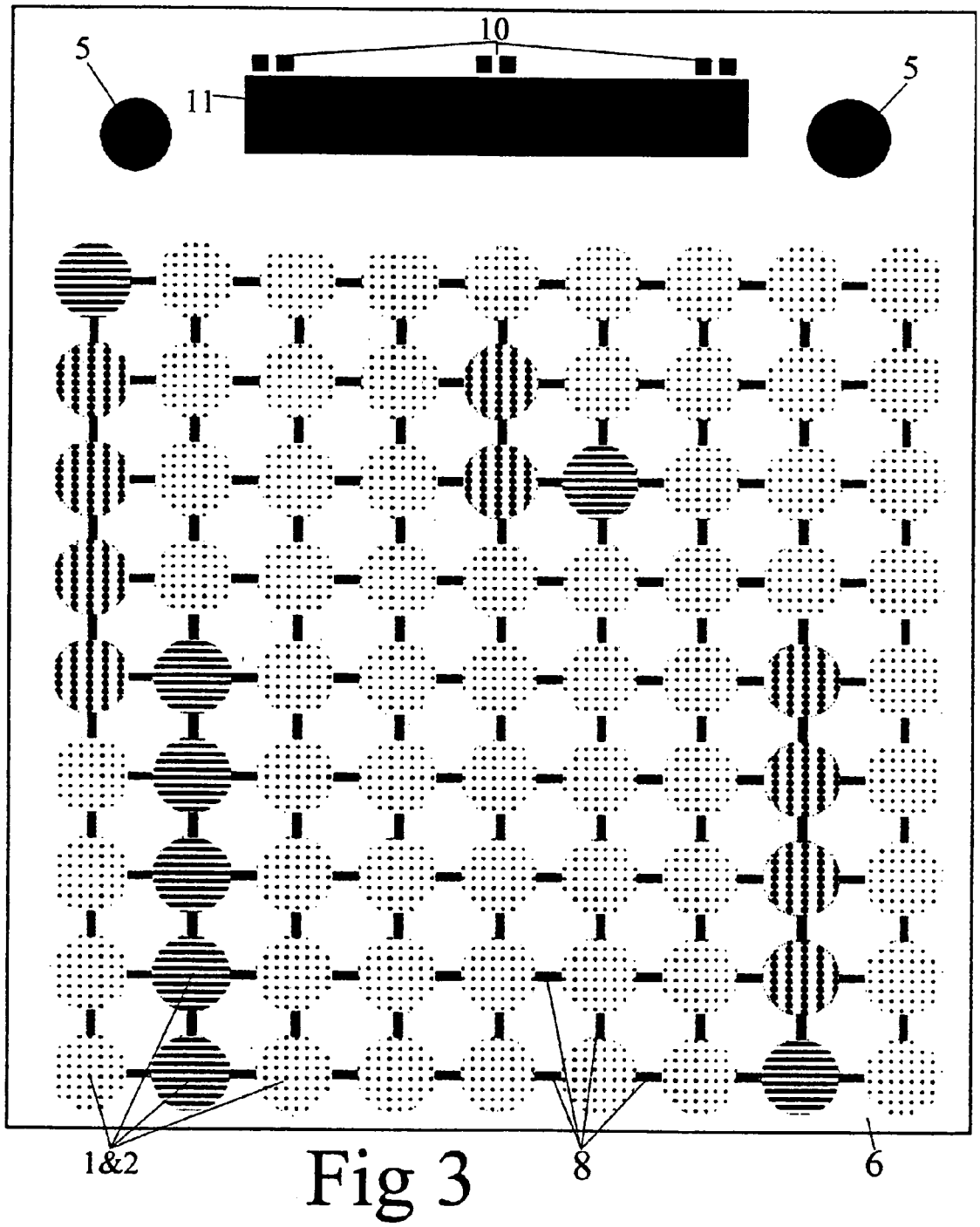
FIG. 3 is a sketch of the way the board looks for players from above.
Figure 4:
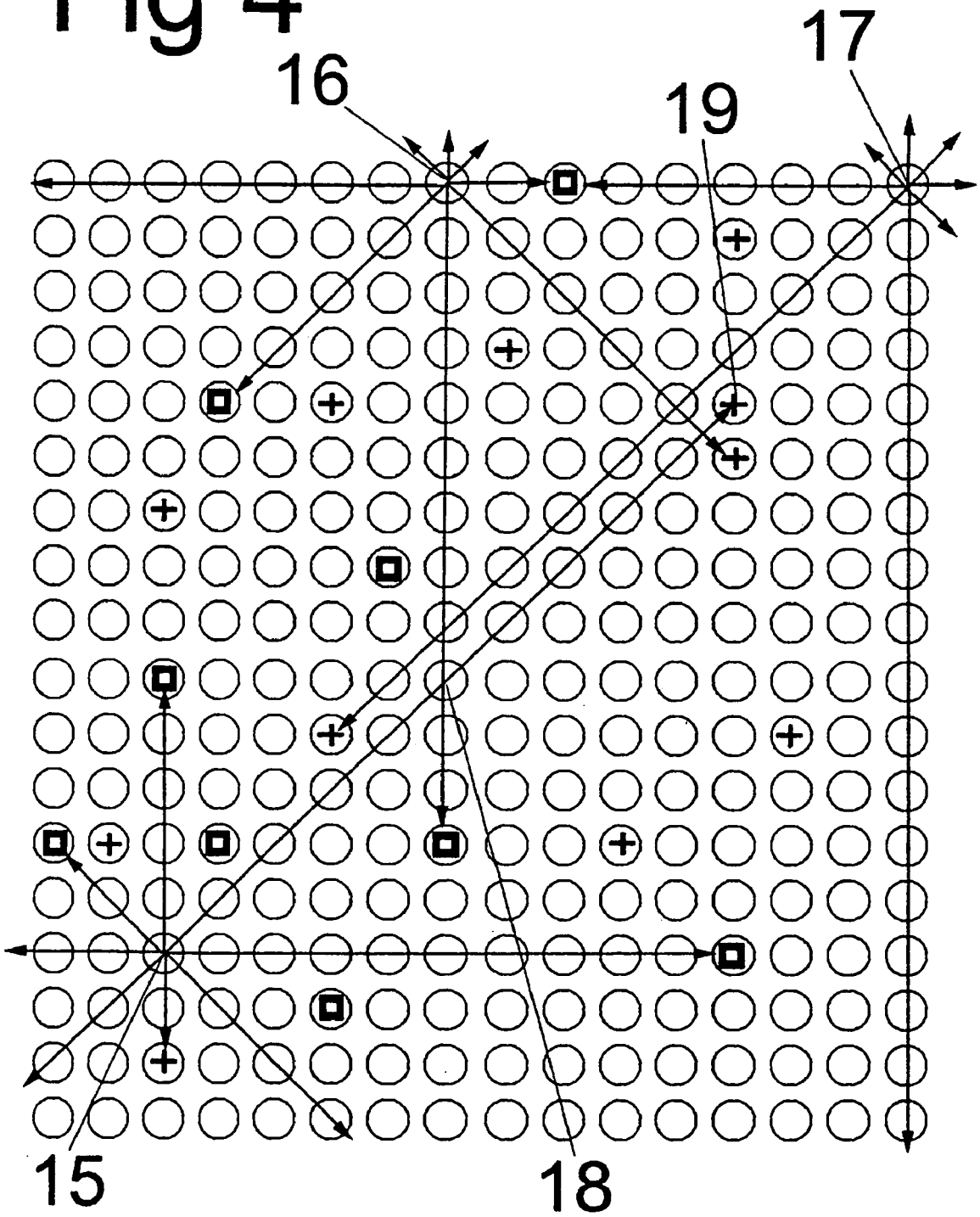
FIGS. 4 and 5 demonstrates the pre-defined imaginary lines in determining the suitable move by a player.
Figure 5:
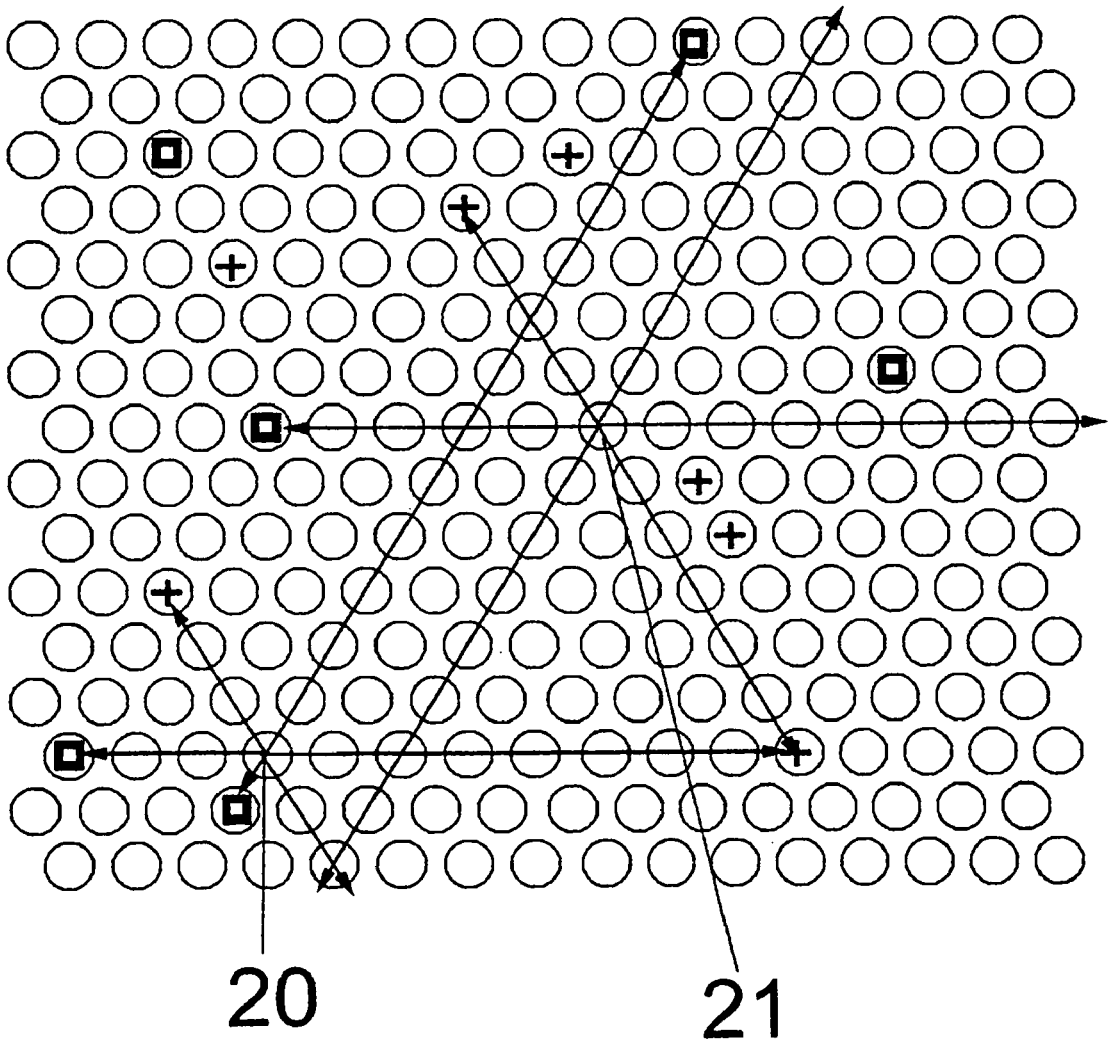

The arrangement of the grid points would be in most cases square as in FIGS. 3 and 4, but can also be of different shapes (e.g. rectangular, hexagonal (as shown in FIG. 5), triangular or less regular). The overall shape of the board would typically be square, but can also vary.

The kind of games that the board will be programmed to play include (but not restricted to):

1) Traditional two-person games like Go, where each player is associated with one colour.
2) Novel two-person games like the one described in this invention.
3) Puzzles and single-player games.
4) Fluid games, which mans games where the patterns of illuminated points changes even when the player(s) don't press any point.
5) Memory games.

The game Visiput:

As is clear from the description of Visiput on p. 2, the central concept of Visiput is the 'visibility' of a point. FIG. 4 demonstrates the calculation of 'visibility' in a square grid where the pre-defined set of imaginary lines is the 8 lines emanating from the point going through the closest 8 points. The circles represent grid points, hollow squares represent points that are illuminated with the player's colour, pluses represent points that are illuminated with the opponent's colour. The arrows emanating from few of the points mark the imaginary lines that are used to compute the 'visibility' for these points. For point 15, three of the lines (left left-bottom, right-bottom) do not pass through illuminated points, and hence have the value 0. Of the rest of the lines, for three lines (top, top-left, right) the closest illuminated point is in the player's colour, so have the value 1, and for 2 lines (bottom and top-right) the closest illuminated point is in the opponent's colour, so they have the value −1. Summing this eight values gives point 15 'visibility' of 1 for the player.

For points on the border of the grid, some of the lines have always a value of 0. For example, for point 16 the three top-lines are always 0. The left line also has the value 0. The bottom-left, bottom and right lines have value 1, the bottom-right line has value −1, and the total 'visibility' is 2. Similarly, point 17 has 5 lines which are always 0.

As the examples demonstrate, the 'visibility' of a point for a player is potentially dependent on the status of points that are very far away. In addition, the 'visibility' of a point is a dynamic state and changes many times as the game progresses. In general, every move can change the 'visibility' of many points, because each point is on the imaginary lines emanating from many points. For example, if the player plays in point 18 in FIG. 4, it will increase by 2 the 'visibility' of all the points on the line from point 18 to point 15 and continuing to the end of the board, because for each of these points one of the imaginary lines goes through point 18 and has value −1, and this line will change its value to 1 once the player switches on point 18. On the other hand, this move will not affect the 'visibility' of point 16 and the points between them, because the line from point 16 to point 18 has already a value of 1. If the player plays in point 15, it will increase by 1 the 'visibility' of all the points on the line from point 15 to point 18 and continuing to point 19, because the line from all of these points through point 15 currently has the value 0, and when the player plays in point 15 the value changes to 1.

FIG. 5 (same notation as FIG. 4) demonstrates the calculation of 'visibility' in an hexagonal arrangement, with the pre-defined set of imaginary lines being the 6 lines through the 6 closest points. For point 20, the value of the lines left, bottom-left and top-right is 1, top-left and right is −1, bottom-right 0, and the total 'visibility' is 1. For point 21, left is 1, top-left and bottom-right are −1, the rest are 0, and the total is −1.

By definition, when the value of a line is 1 for one player, it is −1 for the other player. Therefore the 'visibility' of each point for one player is the negative value of its 'visibility' for the opponent. Since points are legal moves for a player only if its 'visibility' for this player is bigger than or equal to some fixed value, a player can prevent his opponent's from playing in a point by increasing its 'visibility' for himself, and hence decreasing the 'visibility' for the opponent. To win, a player needs to prevent his/her opponent from playing in as many points as possible, while at the same time ensuring that the opponent does not prevent him/her from playing in many points. Because of the long range of 'visibility' and its dynamic nature, Visiput requires a long-term planning and manoeuvres which are coordinated across the whole board, and has a considerable strategic depth. A specific embodiment of the invention will now be described with reference to the accompanying drawings:

FIG. 1 shows the conceptual structure of the board.

Figure 2:
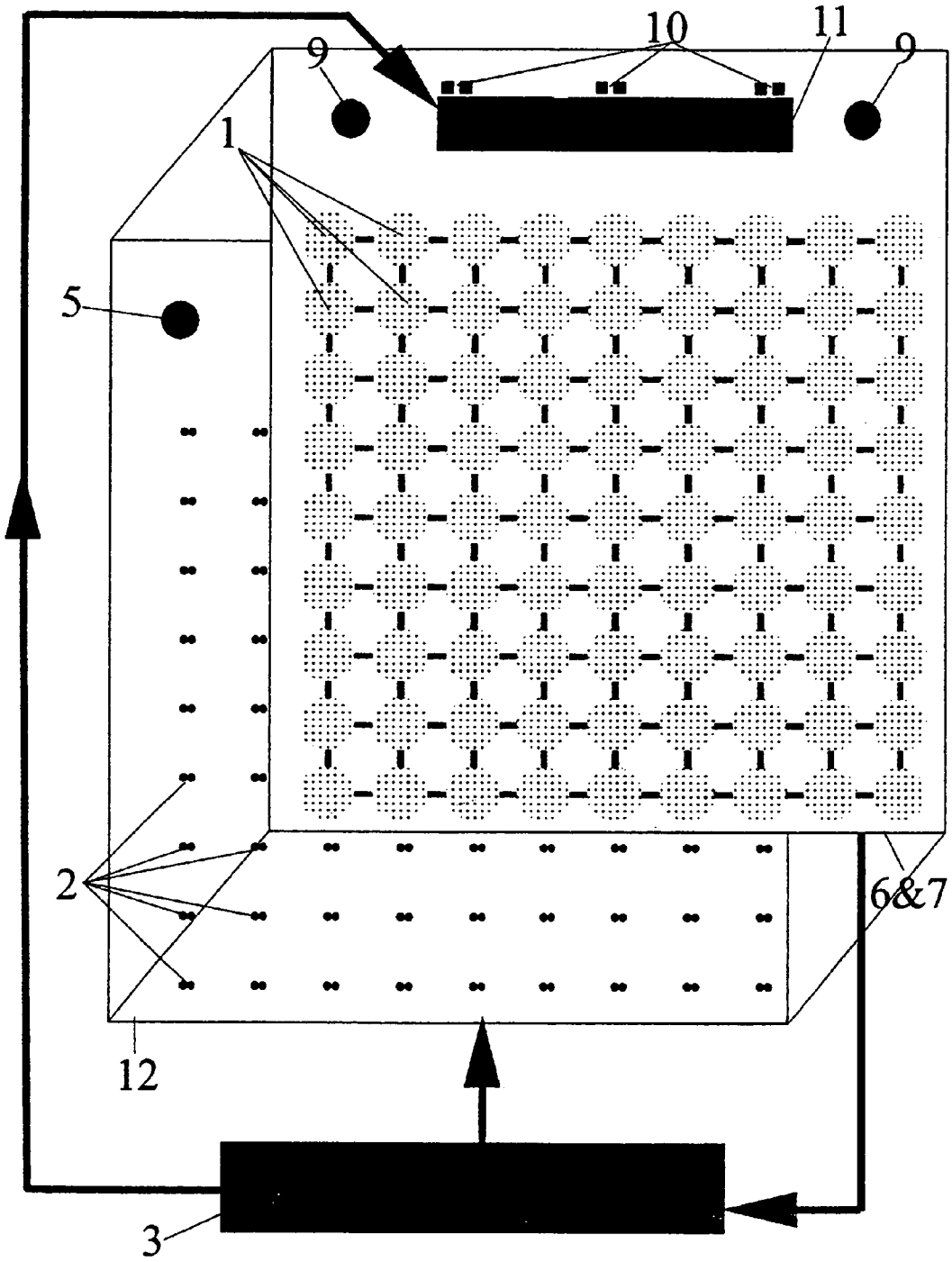
FIG. 2 shows a sketch of the electronic components of an example board.

FIG. 2 shows a sketch of the electronic components of an example board.

FIG. 3 is a sketch of the way the board looks for players from above.

The inputs of grid points 1 are implemented by a custom-design membrane keyboard 7 on a PCB 6, which together comprise the top of a flat rectangular box. The membrane keyboard contains a grid of 9×9 translucent buttons 1, which are in a shape of small domes. Between the buttons the membrane is painted with lines 8 drawn on the imaginary lines connecting the centres of the buttons. The PCB 6 has holes below each button, with additional holes 9 for the turn lights. Both the PCB 6 and the membrane keyboard 7 has a hole for the alphanumeric display 11.

The illumination of the grid points is implemented by 9×9 pairs of LEDs 2 mounted on a PCB 12, which is itself mounted below the membrane keyboard such that each LEDs pair 2 is under the centre of one of the buttons 1. In each pair one LED is of one colour (e.g. green) and the other of another colour (e.g. red). Alternatively, each LEDs pair can be replaced by a bi-colour LED. The two turn lights 5 are implemented by two large LEDs, one in one of the colours of the pairs of LEDs 2, and one in the other colour, mounted on PCB 12 as the rest of the LEDs. The electronic circuitry to drive the LEDs 2 and the turn lights 5 is also on PCB 12.

The membrane keyboard 7 also contains several control buttons 10, which allow the users to control the game (start, stop etc.) and to select which game is played and set parameters for the current game. An alphanumeric display 11 is mounted in a hole in the membrane keyboard 7. The control buttons 10 and the display 11 together comprise the control area 4 of FIG. 1.

All the input from the membrane keyboard goes to the games manager 3, which is a small CPU (around 5 MIPS) and a little ROM and RAM (around 32 Kb and 6 Kb respectively). The games manager 3 is placed below the LEDs PCB 12. A custom design electronic circuitry (denoted by arrows from the membrane keyboard 7 to the games manager 3, and from the games manager 3 to the PCB 12 and to the display 11) allows the games manager 3 to switch on and off each individual LEDs, and to display the appropriate information in the alphanumeric display.

FIG. 3 shows a sketch of the board from above in a middle of a game, with some grid points illuminated. Most of the grid points are not illuminated (circles with points). Some of the points are illuminated in one of two colour (indicated in the figure by two different shading). Because the buttons are translucent (rather than transparent), the LEDs 2 are not actually visible.

The embodiment of the grid points which is described above seems to be the most effective with current technology, but some parts can easily be changed if and when other technologies improve or new technologies become available, without affecting the overall design of the board. The detection of pressing a grid point may be done by any discrete input device, for example standard contact switch and capacitive switch. The illumination of the grid points can be done by other kind of sources, for example gas-discharge lamps and incandescent lamps.

In the embodiment which was described above the players press the grid points with their finger. This is very convenient, which is one of the advantages of the board. However, it has a problem that the board cannot distinguish which player is pressing a point, so the players can press a point out of their turn. The possible solutions to this problem seem to be too cumbersome and in some cases too expensive, so they are not included in the preferred embodiment. However, some of the solutions may prove to be convenient and cheap enough to be acceptable, and if the board is used for formal tournaments it may become an essential requirement.

A cheap and simple solution is to add two buttons on two sides of the board, one for each player, and the player will need to either hold down his own button while pressing a point or to first press his button and then press the point.

Another solution is to have two probes connected to the board, and the players use them to press the points. The contact between the probe and the board creates a short circuit which the board detects and hence can tell which probe, and hence which player, presses the point. An advantage of this solution is that it means that the sensor in each grid point can be a simple conducting element, instead of the membrane keyboard which is described above, which may make the board actually cheaper. Alternatively this method can be used to detect which player presses a point, in combination with another method to detect which point is pressed. For example, a membrane keyboard can be coated with a conducting layer, and the short circuit is caused when the probe touches this layer. In this case the membrane keyboard will detect which point is pressed, and the short circuit detects which player presses it.

Another variation of this solution is that the board emits some signal (electromagnetic or maybe ultrasound), and the probe detects this signal, and the probe that detects the signal more strongly is the one that actually presses. In this case the probe does not need to touch the board, so may be worn by the players, rather than held, which is more convenient. Another variation is that the probe interferes with or reflects the signal, and the board uses this response to detect which player presses the board, in this case, the probe does not need to be connected to the board. Alternatively, the probes themselves may emit different signals.

The solution above requires the players to hold or wear an object, which is uncomfortable. A possible solution is to mark the fingers of the players, by some material that adhere to the skin, and that the board can detect. Even more advanced technology may be able to recognise the fingers of the players directly.

The software:

The central loop of the software repeats these four steps:

1) Check if any of the control buttons was pressed. If any control button was pressed, perform the appropriate operation (change the game, set a parameter, stop the game, start the game).
2) Check if any of the grid points was pressed. If so, compute the implications according to the rules of the current game, perform all the changes to the board and then switch the turn to the other player. Switching the turn means switching the turn light of the current player off, setting the internal variable current layer to the other player, switching the turn light of the other player on and setting a variable, the turn end mark, to the current time plus the turn time.
3) Check the clock and compare it to various time marks. A time mark is a variable set to some value, which is compared to the current time. The most important is the turn end mark, and if this is passed, switch the turn as in 2. Other time marks are for updates of the displays.
4) Check if there are game specific operations to perform. If a player plays one of the two-players games against the board, this check perform the board's move.

Managing Visiput:

The actions that the software perform when a grid point is touched are described schematically in FIG. 6. The operation starts in the box on the top-left, and ends at the bottom. Arrows signify a move to the step in the box that is pointed to by the arrow, except the big thick arrow going to the right from the box with text "Do for each imaginary line emanating from the touched point". If an arrow is marked with "Yes" or "No", it means the move happens only if the answer to the question in the previous box is "yes" or "no" respectively. The Big thick arrow signify iteration, i.e. all the operations in the big box on the top right is performed for each imaginary line.

The example board has these settable parameters for the game Visiput:

1) number of points that should be switched on when the game starts. If this is 0, the game starts with a standard configuration of illumination. Otherwise it start with half of the specified number points illuminated in each colour, in random locations.

2) The minimum 'visibility' for a point to be a legal move. This parameter ranges from −2 to 2, and defaults to 0.

When a player presses a point, the games manager traces all the lines from this point to check its 'visibility' for the player, and if this is too low rejects the move, and then marks all the legal moves for this player. This feature is quite important, because working out if a point is legal is not a simple task, and players can easily get it wrong. If the move is legal, the game manager switches the point on with the player's colour. It then check if all the empty point are already 'decided', where a 'decided' point is a point that is an illegal move for one player or for both, and no legal move can change it. If all the points are decided, the games manager switches all the 'decided' points where one player can play to this player's colour and finishes the game. This save the players this part of the game, which has no interest because no move can change the result.

The invention claimed is:

1. An electronic board comprising:

a grid of grid points on a flat surface, where each grid point is a visible element which is capable of detecting when it is pressed, and can be illuminated in two different colours, by an illumination source inside or below the surface;

which exhibits a behavior which makes it useful for playing various games;

and in one of these games the behaviour of the board is as follows:

the board keeps a record of one of the two colours above as the current player's colour;

the board keeps a record of a fixed number;

when a point is pressed, the board checks if it is a legal move, and if it is switches the point to the current player's colour, and changes the current player's colour record to the other colour;

to evaluate if a point is a legal move, the board checks in turn each of a pre-defined set of imaginary straight lines emanating from the point, assigning a value of 0 to each of these lines that does not pass through an illuminated point, a value of 1 if the closest illuminated point that said line passes through is illuminated with the current player's colour, and −1 if said closest illuminated point is illuminated in the other colour, and then compares the sum of the values of all the lines to said fixed number, and if the sum is larger or equal to said fixed number, the point is a legal move;

when there is no more legal moves, the board declares as winner the colour in which more points are illuminated.

* * * * *